United States Patent [19]

Labbe

[11] 4,397,320

[45] Aug. 9, 1983

[54] CIGARETTE MAKING MACHINE

[75] Inventor: Francis A. M. Labbe, Neuilly-sur-Seine, France

[73] Assignee: Molins Limited, London, England

[21] Appl. No.: 304,609

[22] Filed: Sep. 22, 1981

[30] Foreign Application Priority Data

Sep. 24, 1980 [GB] United Kingdom ..... 8030835

[51] Int. Cl.[3] ..... A24C 5/14; A24C 5/18

[52] U.S. Cl. ..... 131/84 R; 131/84 B

[58] Field of Search ..... 131/84 R, 84 A, 84 B, 131/84 C, 280

[56] References Cited

U.S. PATENT DOCUMENTS 4,207,907 6/1980 Dyett ..... 131/84 B

FOREIGN PATENT DOCUMENTS 829319 3/1960 United Kingdom ..... 131/84 R

*Primary Examiner*—V. Millin

*Attorney, Agent, or Firm*—Antonelli, Terry & Wands

[57] ABSTRACT

A cigarette making machine has a suction tape 10 for carrying the cigarette filler stream 18 onto a wrapper web 22, the tape being supported by a single cable 32 which extends above the edge portions of the operative lower run of the tape and crosses over (at 34 in FIG. 2) beneath the non-operative upper run of the tape. The cable is tensioned sufficiently to provide an adequate frictional drive from one of the pulleys (12) around which the tape and cable pass. The tape needs only slight tension, being driven partly by frictional contact with the cable.

7 Claims, 7 Drawing Figures

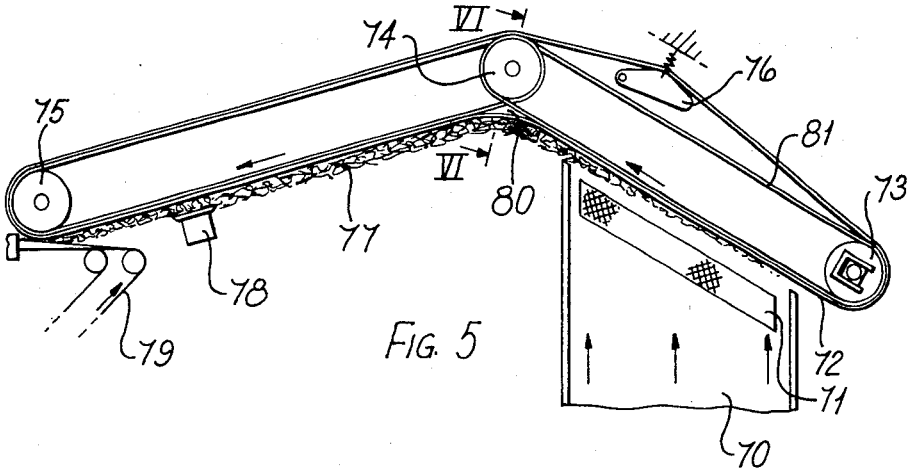
FIG. 5
FIG. 6
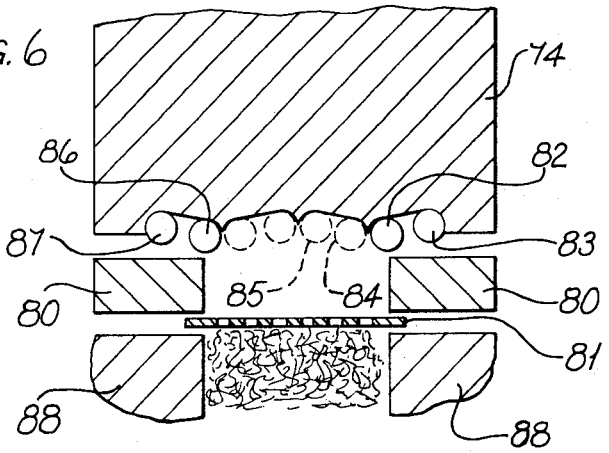
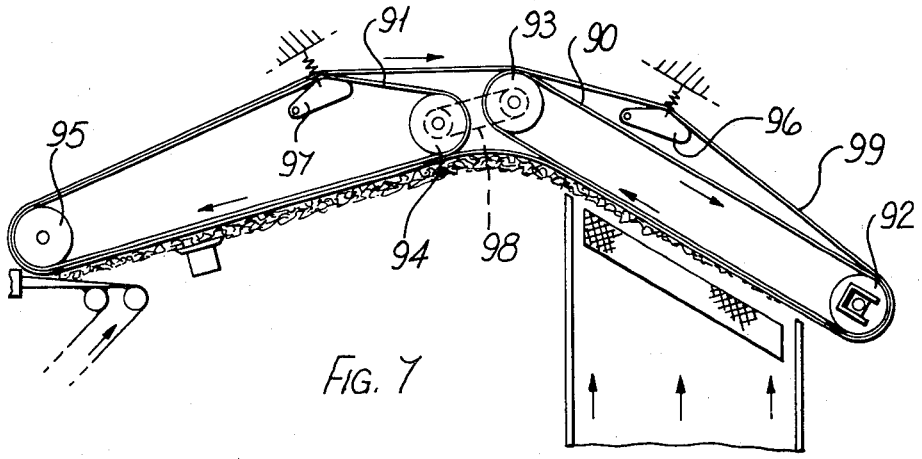
FIG. 7

CIGARETTE MAKING MACHINE

This invention is concerned with cigarette making machines of the type in which a cigarette filler stream is formed on the underneath surface of an air-pervious tape which carries the filler stream by means of suction towards a rod-forming device. At the rod-forming device the filler stream is deposited by the tape onto a continuous wrapper web in which the filler stream is enclosed to form a continuous cigarette rod which is subsequently cut at regular intervals to form individual rods. Examples of such machines are the Molins Mark 8 and Mark 9 cigarette making machines.

It has been usual, for example in the Mark 8 and Mark 9 machines, to support the edges of the tape by means of two spring bands extending respectively along the inner surfaces of the edge portions of the tape. With such a construction, the inner surface of the tape does not contact any fixed part, since the spring bands are interposed. Where the tape passes around a pulley, the spring bands are accommodated in circumferential grooves in the pulley to allow the tape to lie in contact with the pulley. One of the pulleys drives the tape, for which purpose the tape is tensioned so as to engage the drive pulley with sufficient force to provide a frictional drive.

According to one aspect of the present invention, in place of the two spring bands there is a single cable which extends above the edge portions of the operative run of the tape (carrying the filler stream) and crosses over beneath the non-operative run of the tape.

The term "cable" refers particularly to a multi-strand wire element, but is intended generally to cover any similarly flexible element capable of withstanding a significant tension without significant elongation.

The cable is tensioned, preferably by means of a pulley remote from the rod-forming device, so as to receive an adequate drive from the driven pulley which, in a machine like the Mark 8 or Mark 9, is normally the pulley adjacent to the rod-forming device. The tape is separately tensioned so as to provide sufficient frictional drive to overcome the resistance to its movement imposed by the tobacco filler stream.

Use of a cable in accordance with this invention facilitates the use of a narrower tape, thus improving the rod-forming condition since the wrapper web can be formed into a narrower U-section at the point at which the filler stream is delivered onto it. A narrower tape is possible because a cable of adequate strength can be made smaller in diameter than the previous spring bands. Moreover, whereas spring bands could not themselves be tensioned to any significant extent, so that adequate tension for driving purposes had to be applied directly to the tape itself, with the present invention the tape need only be tensioned relatively lightly and can therefore be expected to have a longer life, despite being narrower.

According to another aspect of the present invention, an air-pervious tape in a cigarette making machine has its edges supported by one or more cables including tensioning means whereby sufficient tension is created in the cable or cables to produce a frictional drive from one of the pulleys around which the tape passes, the tape being separately tensioned so as to be driven frictionally, preferably at least partly by the same pulley that drives the cable or cables.

Examples of cigarette making machines according to this invention are shown diagrammatically in the accompanying drawings. In these drawings:

FIG. 5 is a front view of a different machine;

FIG. 6 is a fragmentary section, on a larger scale, through the line VI—VI in FIG. 5; and FIG. 7 is a front view of another different machine.

Figure 1:
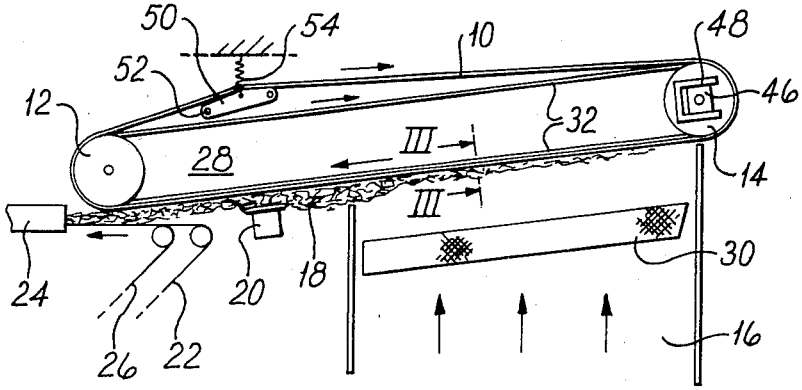
FIG. 1 is a front view of the relevant part of one machine.

The machine shown in FIG. 1 includes a perforated steel tape 10 which runs around two pulleys 12 and 14. Tobacco is carried upwards by air through a chimney 16 to form a cigarette filler stream 18 against the underneath surface of the lower run of the tape 10. After passing a trimmer 20, the filler stream is deposited by the tape 10 on a continuous wrapper web 22 which is carried into a rod-forming device 24 by a garniture tape 26.

The filler stream 18 is held against the tape 10 by suction applied through the tape from a suction chamber 28. This suction also creates part of the upward air flow through the chimney 16, but most of the air flowing up the chimney 16 is produced by a supercharger comprising a louvre opening 30 connected to a suction fan (not shown).

The arrangement so far described is basically in accordance with British patent specification No. 916,141.

Figure 2:
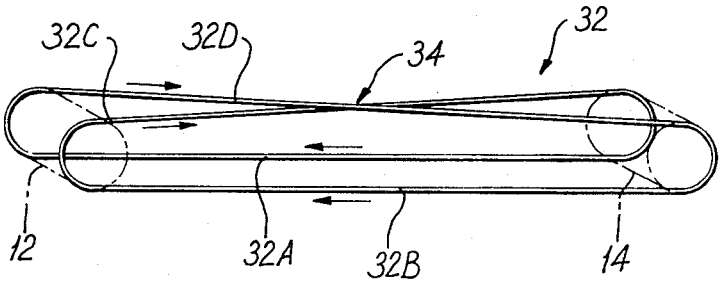
FIG. 2 is a perspective view of the cable supporting the suction tape.
Figure 3:
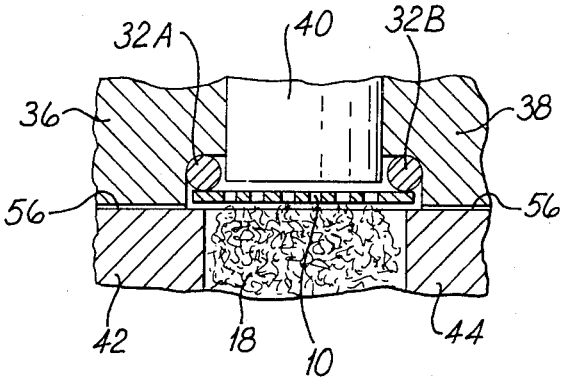
FIG. 3 is an enlarged section on the line III—III in FIG. 1.

Within the suction tape 10 there is an endless cable 32 shown diagrammatically in perspective in FIG. 2. This cable passes twice around each of the pulleys 12 and 14. Parallel lower runs 32A and 32B of the cable support the operative lower run of the suction tape, as shown in FIG. 3. Upper runs 32C and 32C of the cable cross one another at position 34, where there may be means for holding the runs 32C and 32D apart so as to prevent rubbing.

It should be noted that FIG. 2, for the sake of illustration, greatly exaggerates the distance between the lower runs 32A and 32B of the cable. As an idea of scale, the tape 10 may, for example, be 10 mm wide, while the distance between the axes of the pulleys 12 and 14 may be of the order of 2.5 meters.

As shown in FIG. 3, the lower runs 32A and 32B of the cable lie in corner recesses in walls 36 and 38 which partly define the suction chamber 28. Studs 40 are mounted between the walls at regular intervals along the cable to prevent movement of the runs 32A and 32B towards one another. It will also be noted from FIG. 3 that the lower runs 32A and 32B of the cable lie along the upper surface of edge portions of the tape 10, with the sides of the cables approximately vertically aligned with the edges of the tape. Two fixed rails 32 and 44 confine the sides of the cigarette filler stream 18.

The cable 32 is tensioned by moving the pulley 14 away from the pulley 12, which rotates about a fixed axis and receives the drive input. As shown diagrammatically in FIG. 1, the pulley 14 is mounted in bearings in blocks 46 which are slideably mounted in fixed members 48 on opposite sides of the pulley. Any conventional arrangement may be used for urging the pulley 14 to the right to tension the cable.

Where the cable passes around each pulley, it is accomodated in a groove in the pulley having a depth equal to the diameter of the cable, so that the central region of the tape is in contact with the periphery of the pulley.

The suction tape 10 is lightly tensioned by means of a guide 50 which is pivoted at 52 and is urged in a counter-clockwise direction by a spring 54 so as to apply an upward force on the upper run of the tape 10. The tension in the tape 10 need only be sufficient to ensure that the frictional drive from the pulley 12 is adequate to overcome mainly the resistance imposed by contact of the cigarette filler stream with the rails 42 and 44 and with the extensions of the rails beyond the area of the chimney 16, especially when the machine is being started (at which stage there is an additional resistance). Only slight tensioning of the tape is needed since the tape is also pressed against the lower runs of the cable by the action of the suction, and that produces a tractive force on the tape. For example, whereas a force of approximately 40 pounds may be applied to the pulley 14 (giving a tension in each run of the cable of 10 pounds), it is expected that a tension of approximately 2 pounds may be adequate for the tape 10. Compared with our prior arrangements, in which the tape was supported by spring bands and therefore had to be under considerable tension, the tape 10 according to the present invention is expected to have a significantly longer life because of the lower tension.

With reference to FIG. 3, it should be noted that the edge portions of the tape 10 are slightly spaced from the upper surfaces of the rails 42 and 44. It will be appreciated that suction pressure tends to urge the tape upwards, thus maintaining a running clearance between the tape and the rails. In order to reduce the possibility of tobacco dust accumulating in the gap between the tape and the rails, the following provision has been made. At regular intervals along the tape 10, the adjacent surfaces of the walls 36 and 38 and rails 42 and 44 are spaced apart to form air inlets 56. In view of the suction pressure inside, air flows in through these inlets from the atmosphere and tends to remove any tobacco dust or other debris which might tend to accumulate between the tape and the rails.

The upper runs 32C and 32D of the cable may be held apart by a freely rotatable disc having a thin peripheral portion lying between the respective runs and having an axis of rotation at right angles to the plane containing the runs 32C and 32D.

Figure 4:
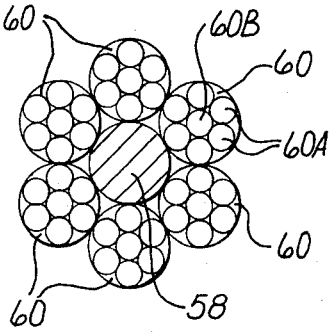
FIG. 4 is an enlarged cross-section through the cable.

The construction of the endless cable 32 is shown in FIG. 4. Helically wound around a fibre core 58 are six strands 60 each comprising six galvanised steel wires 60A of 0.006 inch diameter wound helically around a similar central wire 60B, the overall diameter of the cable being 1.5 mm. The wires are wound so as to produce an endless cable with long-overlap splices of the wires. The ends of the respective wires are staggered so that the tensile strength of the cable is substantially uniform at various positions along the cable. At the ends of the wires, small quantities of solder or adhesive may be applied to ensure that the wires do not unravel.

FIG. 5 shows a different machine. As in FIG. 1, tobacco is carried upwards pneumatically through a chimney 70 with the aid of a supercharger 71. However, the upper end of the chimney is inclined so that tobacco travelling up the chimney has a component of movement in the direction of the adjacent operative run of a suction tape 72, where the tape is arranged to run in the direction from a pulley 73 to a drive pulley 74. As it approaches the pulley 74, the direction of movement of the tape 72 changes from an upwardly inclined direction to a downwardly inclined direction towards a further pulley 75. A tensioning device 76 for the tape acts in the same manner as the device 50 in FIG. 1.

As in FIG. 1, the tape carries a tobacco filler stream 77 past a trimmer 78 and onto a wrapper web 79, being arranged to carry the filler stream by the action of suction as in FIG. 1.

Except in the region of the pulley 74, where the tape 72 moves along a curved path adjacent to the curved lower edge of a pair of fixed members 80, the tape is supported and carried forward with the aid of a single cable 81 which forms a pair of double loops around the pulleys 73 to 75. The lower runs of the cable lie in two different vertical planes, and there is a cross-over point as in FIG. 1. This will be explained with reference to FIG. 6.

The near-side edge of the tape 81 is supported between pulleys 73 and 74 by a cable run lying in the position of the cable section 82 shown in FIG. 6. A complete turn of the cable around the pulley 74 brings the cable to the position 83; as the cable moves along the upper surface of the adjacent fixed member 80, it is moved by a guide (not shown) back to the vertical plane of the portion 82, and the cable remains in that plane while supporting the tape during its movement towards the pulley 75. After passing around the pulley 75, the cable moves from the plane of the portion 82 to the plane occupied by the dotted outline 84 in FIG. 6 (though at the top of the drive pulley 74) and it then passes all the way around the pulley 74, leaving at approximately the plane occupied by dotted outline 85 (again at the top of the pulley). The cable then moves back towards the pulley 73, during which movement it crosses over to occupy the plane of the portion 86 in FIG. 6; and it remains in that plane while passing around the pulley and while supporting the far-side edge of the suction tape during its movement towards the pulley 74. On again passing around the pulley 74, the cable arrives in the plane of the portion 87 and is then guided back to the plane of the portion 86 while moving along the upper surface of the adjacent member 80. Further movement of the cable forms a mirror image of the movement already described, the cross-over point (of upper runs of the cable) being between the pulleys 73 and 74 where the tape is held clear of the cable by the tensioning device 76.

Where the lower run of the tape moves along the curved path adjacent to the lower surfaces of the members 80 and out of contact with the cable, the upward force on the tape caused by suction holding on the tobacco is just sufficient to balance the tension in the tape, so that the edges of the tape do not contact rails 88 with any significant force; indeed, the arrangement is preferably such that the edges of the tape remain slightly clear of both the rails 88 and the fixed members 80, at least in theory. For that purpose, the curvature of the lower surfaces of the members 80 would ideally not be at a precisely constant radius; instead the radius of curvature would increase slightly at positions further towards the left.

Instead of passing all the way around the pulley 74 for a second time (in returning from pulley 75 to pulley 73), the cable may simply pass over the top of the pulley 74.

As an alternative in FIG. 5, instead of a single cable there may be two separate endless cables for supporting respectively the near and far edges of the tape, each cable being arranged to pass around all three pulleys and to wrap completely around the drive pulley 74. In that case, there is preferably separate provision for tensioning the two cables. For example, the pulley 73 may be adjustable in position away from the pulley 74 to provide a basic tensioning for at least one of the cables, and the upper run of at least one of the cables moving from pulley 74 to pulley 73 may be diverted laterally by a set of pulleys including a tensioning pulley. Alternatively, the pulley 73 may be formed in two separate parts lying side by side, each part serving one of the cables and being movable away from the pulley 74 to tension the respective cable; the tape 81 would then extend beyond the pulley 74 and return around an additional pulley (i.e. lying approximately to the right of the pulley 73) by which the tape may be tensioned.

FIG. 7 shows a different machine of which the geometry is generally similar to FIG. 5. However, this machine differs in that it has two separate cables 90 and 91 each of which crosses over (at its upper runs) as shown in FIG. 2, so as to support both edges of a tape 99 along part of the operative lower run of the tape. The cable 90 passes around pulleys 92 and 93, while cable 91 passes around pulleys 94 and 95. The pulley 92 is movable away from pulley 93 to tension the cable 90, while the cable 91 is tensioned by a device 97 similar to the tape tensioning device 50 in FIG. 1. A similar tensioning device 96 is provided for the tape.

The cables 90 and 91 are driven respectively by the pulleys 93 and 94, which are coupled together (e.g. by a timing belt 98 as shown) so as to run always at an identical speed.

As an alternative, the cable 90 in FIG. 7 may be replaced by a wide porous tape.

I claim:

1. A cigarette making machine including an air-pervious tape which is arranged to carry a cigarette filler stream, with the aid of suction, towards a rod-forming device in which the filler stream is enclosed in a continuous wrapper web to form a continuous cigarette rod, the edges of the operative run of the tape being supported by an endless moving cable arranged to form two parallel lower runs which lie above and extend along edge portions of the operative lower run of the tape in contact therewith, and upper runs which cross over beneath the non-operative upper run of the tape.

2. A cigarette making machine according to claim 1, in which the endless cable is arranged to pass around two horizontally spaced pulleys and is tensioned so as to be frictionally driven by one of the pulleys, and including separate means for tensioning the tape.

3. A cigarette making machine according to claim 2, in which the tape tensioning means comprises a movable member which is arranged to urge the upper run of the tape upwards and away from the upper runs of the cable.

4. A cigarette making machine according to claim 1, 2 or 3 in which the tape is arranged to be driven partly by frictional contact with the pulley driving the cable, and partly by contact with the cable under the influence of the suction pressure holding the filler stream on the tape.

5. A cigarette making machine according to claim 1, 2 or 3, including two pulleys defining an upwardly inclined path for the cable and tape above a chimney through which tobacco is delivered to form the cigarette filler stream on the underneath surface of the tape, and a further pulley defining a downwardly inclined path for the cable and tape as they approach the wrapper web on which the filler stream is deposited.

6. A cigarette making machine according to claim 1, in which the cable is formed by a number of strands wound helically around a core, each strand comprising a number of wires wound helically around a centre wire, and in which the ends of various of the wires are joined by overlap splices at staggered positions along the cable.

7. A cigarette making machine including an air-pervious tape which is arranged to carry a cigarette filler stream, with the aid of suction, towards a rod-forming device in which the filler stream is enclosed in a continuous wrapper web to form a continuous cigarette rod, the edges of the operative run of the tape being supported by one or more cables including first tensioning means whereby sufficient tension is created in the cable or cables to produce a frictional device from one of the pulleys around which the tape passes, and second tensioning means whereby the tape is tensioned.

* * * * *